US005482158A

United States Patent [19]

Plester

[11] Patent Number: 5,482,158

[45] Date of Patent: Jan. 9, 1996

[54] PROMOTIONAL DEVICE FOR DELIVERING A PRIZE FROM A BEVERAGE CAN

[75] Inventor: George Plester, Brussels, Belgium

[73] Assignee: The Coca-Cola Company, Atlanta, Ga.

[21] Appl. No.: 347,091

[22] Filed: Nov. 23, 1994

[51] Int. Cl.[6] ..... B65D 85/72

[52] U.S. Cl. ..... 206/217; 206/232; 206/459.5; 206/831; 426/112

[58] Field of Search ..... 206/217, 232, 206/457, 459.1, 459.2, 831; 215/6, 227, 228, 388, 389; 220/705–710; 426/112

[56] References Cited

U.S. PATENT DOCUMENTS

| | | | |
|---|---|---|---|
| 3,656,654 | 4/1972 | Brinkley, III . | |
| 4,109,817 | 8/1978 | Payne et al. . | |
| 4,228,913 | 10/1980 | Mack et al. . | |
| 4,305,521 | 12/1981 | Komatsuta et al. . | |
| 4,356,927 | 11/1982 | Cooper et al. . | |
| 4,537,324 | 8/1985 | Wang . | |
| 4,690,294 | 9/1987 | Jones . | |
| 4,709,829 | 12/1987 | Johnson et al. . | |
| 4,728,001 | 3/1988 | Serba . | |
| 4,826,034 | 5/1989 | Forbes . | |
| 4,892,187 | 1/1990 | Stein . | |
| 4,911,320 | 3/1990 | Howes . | |
| 4,923,083 | 5/1990 | Forbes . | |
| 4,923,084 | 5/1990 | Forbes . | |
| 5,046,631 | 9/1991 | Goodman | 220/694 |
| 5,056,659 | 10/1991 | Howes et al. . | |
| 5,056,681 | 10/1991 | Howes . | |
| 5,071,019 | 12/1991 | Sizemore | 215/388 |
| 5,172,827 | 12/1992 | Chang et al. . | |

FOREIGN PATENT DOCUMENTS

| | | |
|---|---|---|
| 0079673 | 10/1982 | European Pat. Off. . |
| 0078789 | 11/1982 | European Pat. Off. . |
| 0444385 | 5/1990 | European Pat. Off. . |
| 0482776 | 10/1991 | European Pat. Off. . |
| 2217677 | 11/1989 | United Kingdom . |
| 2237789 | 5/1991 | United Kingdom . |
| 8901750 | 3/1989 | WIPO . |

*Primary Examiner*—Jimmy G. Foster

[57] ABSTRACT

A container assembly for housing liquid products and a prize therein which may be distributed with non-prize bearing containers comprising: a can for containing the liquid product in an interior chamber thereof, and a prize-holding subassembly positioned within the interior chamber for retaining a prize therein. The prize holding subassembly includes an expandable base portion which expands outwardly against interior side walls of the can to firmly grip the same in response to placing a closure on an open end of the can. The prize within the subassembly is moveable between a storage position within the can and a second position in juxtaposed, exposed relationship with the open end of the can in response to opening of the closure means.

28 Claims, 3 Drawing Sheets

PROMOTIONAL DEVICE FOR DELIVERING A PRIZE FROM A BEVERAGE CAN

BACKGROUND OF THE INVENTION

The present invention relates to a container assembly for housing liquid products and a prize therein which may be distributed with non-prize bearing containers. More specifically, the present invention relates to a prize-holding subassembly for insertion into a beverage can which is self-securing and accurately positionable therein.

A device, which delivers a prize on opening a beverage can, has significant promotional advantages. Such a device is described by Howes (U.S. Pat. No. 5,056,659), but relies on a system which requires that the device be welded, or glued, to the can-lid, and includes springs and other devices. Other proposals have been made, but all rely on some means of fixing the device to the can lid, such as by welding. Welding requires lids with specially-coated undersides, which preclude using the device in conjunction with the normal lids. Since the device must be mixed into the normal production of beverage cans, the need to use special can lids is disadvantageous, since this could provide a clue as to the cans containing prizes.

Additionally, misalignment in known devices can result in the jamming, or non-opening of the can lid, with the result that consumer access is prevented. Failure of the device should not only be rare, but should not prevent that the beverage is accessed and drunk normally.

SUMMARY OF THE INVENTION

Accordingly, it is a primary object of this invention to provide a prize-delivering device for insertion into a beverage can, which avoids the limitations of previous devices, and particularly:

(1) Enables use of materials for the device, all of which are compatible with the beverage, so that the can may contain both the prize and a consumable beverage.

(2) Avoids welding, or other means, which limit application to a special can lid.

(3) Ensures that misalignment, or other errors in installing the device in the can, cannot lead to failure of the consumer to access the beverage.

(4) Provides a system which cannot be detected before opening (e.g. by attempting to shake or rattle the prize within the can).

(5) Provides a system, which can be easily applied in a slowly-turning can filling line, without spillage, and without the need for special equipment (except possibly for inserting the prize holders into the cans, which can also be achieved manually).

(6) Provides a container assembly with a simple construction, with few parts, to enhance reliability of the prize-delivery function.

The objects of the present invention are fulfilled by providing a container assembly for housing liquid products and a prize, comprising:

a can for containing the liquid product, said can having an open end and closed end, and sidewalls connecting the open and closed ends, said sidewalls having interior surfaces defining an interior chamber;

prize holding means positioned within said interior chamber for retaining the prize therein, said prize holding means having at least a portion thereof which is expandable outwardly against the interior surfaces of the sidewalls for firmly gripping the sidewalls and securing the prize holding means in a fixed position relative thereto;

closure means cooperatively associated with the open end of the can for opening and closing the same; and prize presentation means for moving the prize between a first storage position within the prize holding means and a second position in juxtaposed, exposed relationship with the open end of the can in response to opening of the closure means.

BRIEF DESCRIPTION OF DRAWINGS

The present invention will be more readily understood from the detailed description hereinbelow and the accompanying drawings, which are given by way of illustration only and thus not limiting to the present invention, and wherein.

DETAILED DESCRIPTION OF PREFERRED EMBODIMENTS

Figure 1:
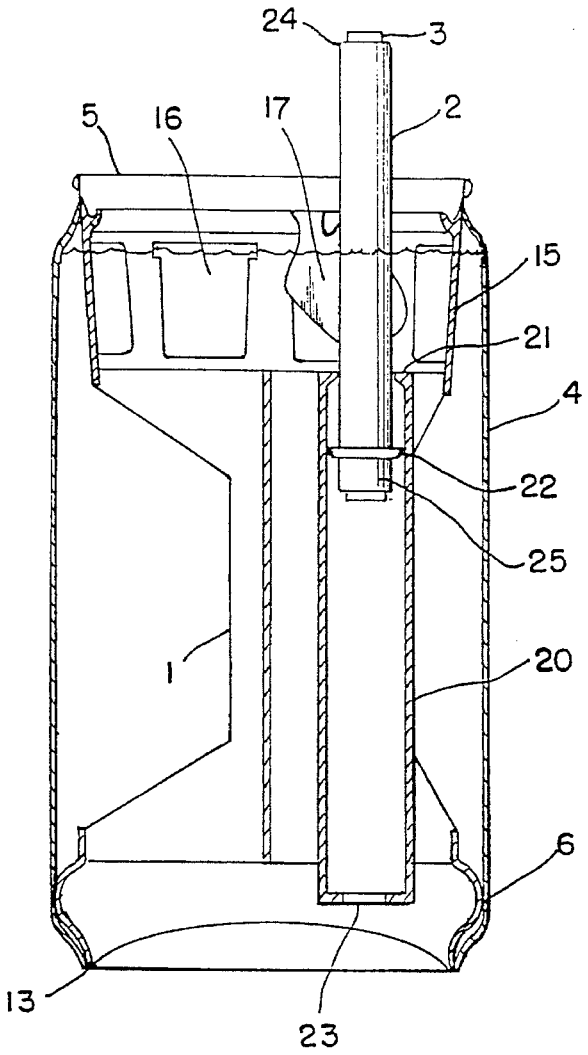
FIG. 1 is a sectional view of the prize holder of the present invention installed within a beverage can in a firmly-located position, with a vial which has risen out into its delivery position after the can lid has been opened.
Figure 1A:
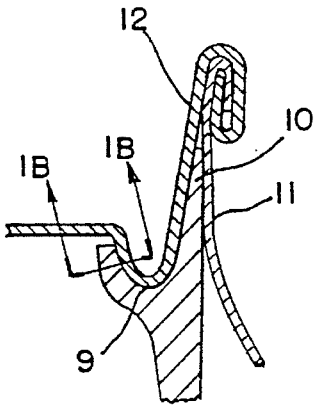
FIGS. 1A and 1B show details of the holding and gripping arrangement in FIG. 1 of the prize holder against the can lid.
Figure 1B:
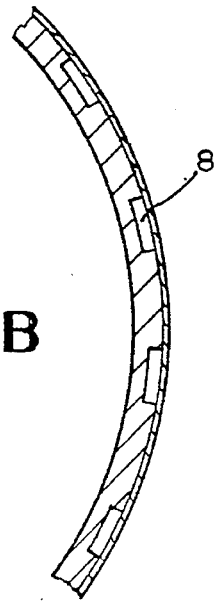

FIG. 1 shows a prize-holder 1, a vial 2 and a rolled-up sachet 3 containing the prize. The prize-holder 1 is installed in a can 4. A can-lid 5 locates in the channel 9 on the top-section of the prize-holder 1, and presses the prize-holder 1 down so that its legs 6 are bowed outwardly and grip the interior surfaces of the sidewalls of can 4. These legs 6 have ribs 7 (see FIGS. 2, 4) which grip the sidewalls of can 4 and prevent rotation, and the slots 8 (see FIG. 1B) in channel 9 have the same purpose at the top of the prize-holder 1, which locates in the rim 14 of can lid 5. The channel 9 has a tapered upper lid 10 which just fits within a can-seaming section of can 1 and provides additional support by being gripped between the top side-wall 11 of the can 1 and the side-flange 12 of can-lid 13, providing further location, alignment and support.

Summarizing, alignment of the prize-holder 1 is positively achieved by the location of legs 6 in can-base section 13 and by location of channel 9 in the rim 14 of can lid 5. Fixing at the base of the prize-holder 1 is positively achieved by the outward-expansion and bending of legs 6, the ribs 7 and the friction of legs 6 in the can-base section 13. At the top of prize-holder 1 fixing is achieved by the pinching of the tapered upper lip 10, the friction of rim 14 of can lid 5 in channel 9 and the grip of slots 8 in cooperation with the protrusions therebetween.

Figure 2:
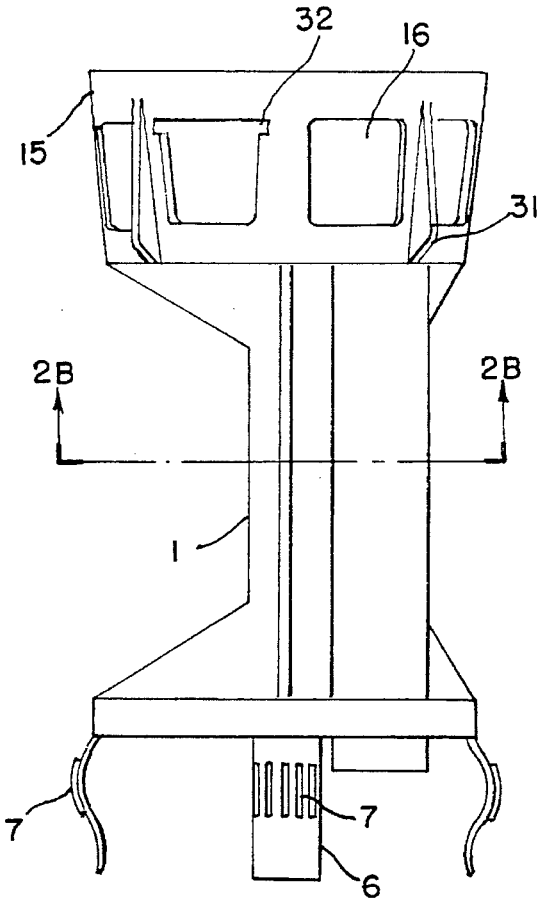
FIG. 2 is a side elevational view of the prize holder subassembly of FIG. 1 outside of the can.
Figure 2A:
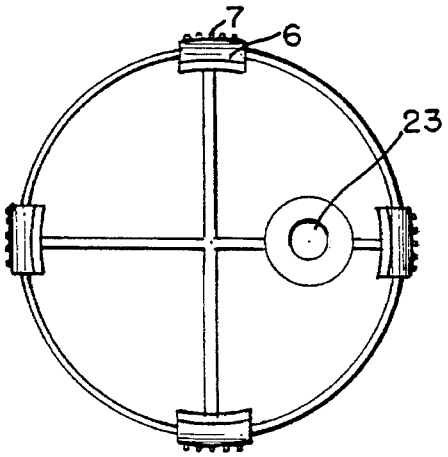
FIG. 2A is a bottom plan view of the prize holder subassembly of FIG. 2.
Figure 2B:
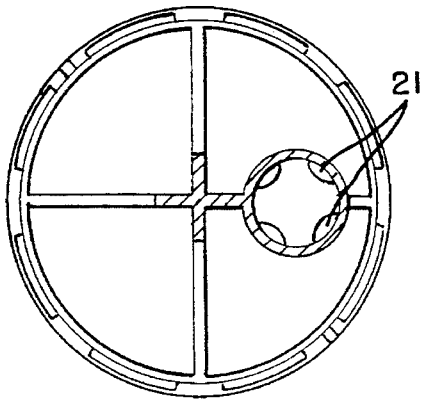
FIG. 2B is a top plan view of the prize holder subassembly of FIG. 2.
Figure 5:
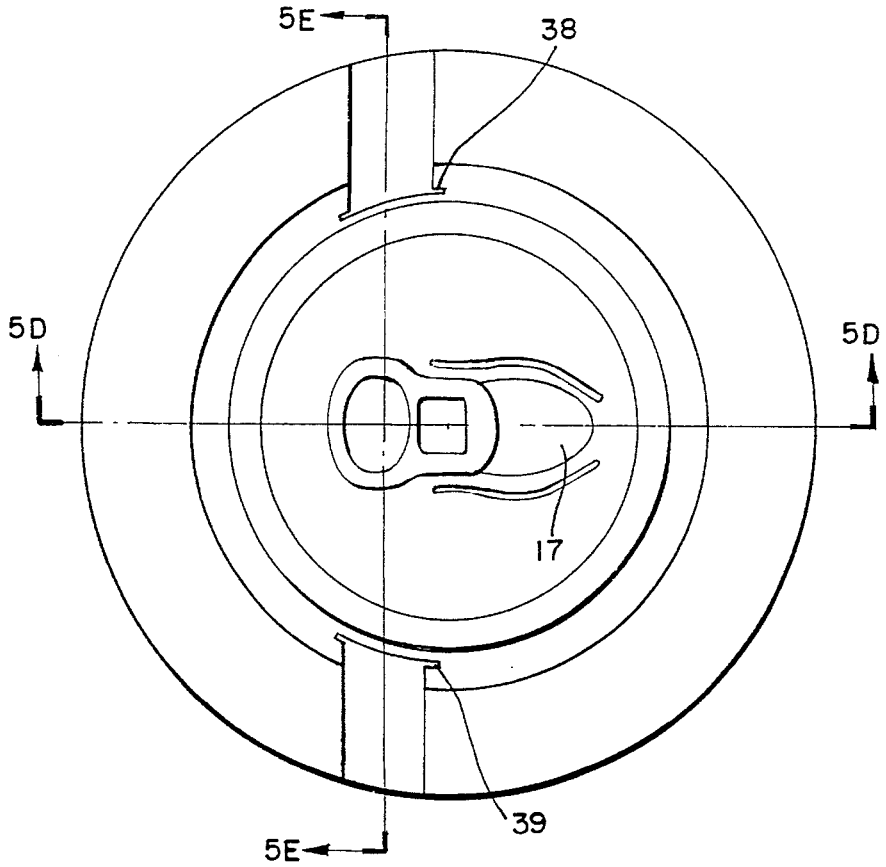
FIG. 5 is a top plan view of a can lid for use in cooperation with an alignment jig.
Figure 5D:
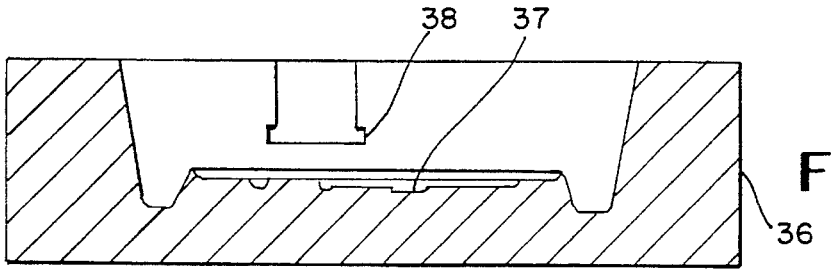
FIG. 5D is a cross-sectional view taken along lines 5D—5D of FIG. 5.
Figure 5E:
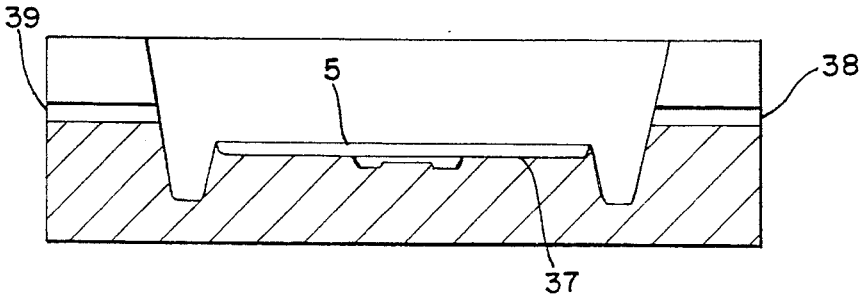
FIG. 5E is a cross-sectional view taken along lines 5E—5E of FIG. 5.
Figure 6:
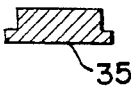
FIG. 6 is a cross-sectional view of an alignment bar for use in cooperation with the alignment jig.

Referring to FIGS. 2, 2A, and 2B the top-section 15 of prize-holder 1 is tapered to ease insertion onto the can 4 and has multiple apertures 16 which permit the beverage to flow out of the can 4, and empty completely without impediment. For this purpose and to prevent beverage displacement/spilling during insertion into the can (when this is full of beverage after filler), the tops of aperture 16 are close to the underside of can lid 5. The shape of top-section 15 is such that the opening-tab 17 cannot touch it, even if the prize-holder is misaligned.

Figure 3:
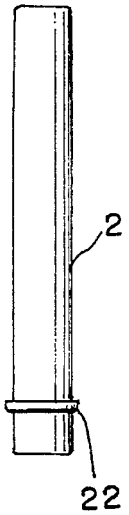
FIG. 3 is a side elevational view of a vial for containing and presenting a prize for use in the prize holder subassembly of FIG. 2.

The prize-holder 1 comprises a vial-holder 20 in which vial 2 of FIG. 3 is fitted. The vial-holder (20) has protrusions 21 which interfere with a flange 22 on vial 2, so that physical effort must be exerted by user to remove vial 2, and this cannot fall out inadvertently. The vial-holder 20 has a base-hole 23 (FIG. 1) which dampens movement of vial 2 in vial-holder 20, and prevents that presence of vial 2 in can 4 might be detected by shaking can 4 to knock vial 2 against can lid 5. It also prevents vial 2 from exiting from can 4. Vial 2 has bull-nose 24 which facilitates/smoothes exit of vial 2 from the can lid discharge opening surrounding tab 17.

Behind flange 22 on the vial 2 is a protrusion (not shown) whose purpose is to prevent the vial 2 from being able to exit from the can 4, if installed back-to-front. If the vial 2 is installed back-to-front, the protrusion (25) prevents the opening-tab 17 from sweeping past it, so that the vial 2 remains behind the opening-tab 17 and cannot exit the can 4. This is to avoid that incorrect installation may lead to the circumvention of the retaining function of flange 22. A similar effect may also be provided by making vial 2 double-sided (i.e. with a flange 22 at each end) but this had the disadvantage of being more likely to fail to exit the can 4.

Vial 2 contains sachet 3 (see FIG. 4) which in turn contains the prize and some trapped air. The trapped air in sachet 3 makes it buoyant. When can-lid 5 is opened normally by pressing-down the tab 17, the tab 17 sweeps past vial 2 and vial 2, buoyed by the air in sachet 3, lifts itself out of the can and can be removed by the user.

Figure 4:
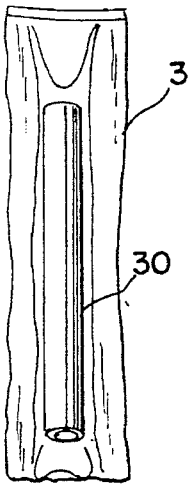
FIG. 4 is a side elevational view of an unrolled sachet, and prize therein, to be housed in the vial of FIG. 3.

In FIG. 4 sachet 3 is shown unrolled with a rolled up prize 30. FIGS. 2A and 2B show important sections of prize-holder 1 and in particular the protrusion 21 and the damping base-hole 23, already described. Also shown are fins 31 which grip and slide against the neck of can 4 during insertion of prize holder 1 into a filled beverage can 4.

It is essential that prize-holder 1 is aligned with respect to can-lid 5 so that the vial-holder 20 is directly under the opening- tab 17, permitting free passage of vial 2 out of can 4. This alignment is facilitated by two of the multiple apertures 16 which are in line with one another at opposite sides of top-section 15 and which have additional slots 32.

Referring to FIGS. 5, 5D, 5E and 6, an alignment rod 35 (shown in section) may be made to tightly fit these slots 32 and be passed through these slots 32 and similar slots 38, 39 in an alignment jig 36. The alignment jig 36 is constructed so that the outside surface of the can-lid 5 fits only in one position in its cavity by shaping the surface 37 of this jig 36 to conform exactly to the can-lid 5 and its opening-tab 7. When the prize-holder 1 is placed together with the can-lid 5 in the alignment jig 36, the alignment rod 35 may only pass through the slots 32 in prize-holder 1 and the similar slots 38, 39 in the alignment jig 38, when can-lid 5 and prize-holder 1 are fully aligned. The can-lid 5 and the prize-holder 1 are held in the alignment jig 36 by the alignment rod 35 until the prize-holder 1 is inserted into the can 4 and the alignment rod 35 is removed. Then, the alignment jig 36 can also be removed allowing the can-lid 5 to be seamed conventionally.

The insertion method is thus to fit can-lid 5 and prize-holder 1 including vial 2 and sachet 3 together to form a single assembly, using the alignment jig 36, invert the assembly of these parts, including the jig 36 and insert the prize-holder 1 into a filled can. Fins 31 locate this assembly in the can, enabling the alignment rod 35 to be withdrawn and the alignment jig 36 to be removed, so that the prize-holder 1 may be pushed fully into the can by the seamer. Thus the described ready-aligned assembly can be manually inserted in the filled can 4 in a slow-running filing line between filler and seamer and the device sealed in the can 4. To ensure ease of insertion and prevent splashing or beverage spillage, the prize-holder has strengthening ribs and other protrusions which are generally in line with its direction of entry into the beverage as shown by the figures. The filling method described can also be automated by conventional means.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A container assembly for housing liquid products and a prize, comprising:

a can for containing the liquid product, said can having an open end and closed end and sidewalls connecting the open and closed ends, said sidewalls having interior surfaces defining an interior chamber;

prize holding means positioned within said interior chamber for retaining the prize therein, said prize holding means having at least a portion thereof which is expandable outwardly against the interior surfaces of the sidewalls for firmly gripping the sidewalls and securing the prize holding means in a fixed position relative thereto;

closure means cooperatively associated with the open end of the can for opening and closing the same; and prize presentation means for moving the prize between a first storage position within the prize holding means and a second position in juxtaposed, exposed relationship with the open end of the can in response to opening of the closure means.

2. The container assembly of claim 1 wherein the expandable portion of the prize holding means includes a skirt at a base end thereof for engaging the closed end of the can, and expanding against the interior surfaces of the sidewalls in response to compression of the skirt against the can end.

3. The container assembly of claim 2 wherein said skirt comprises a plurality of spaced legs which bow outwardly against the interior surfaces of the sidewalls in response to said compression.

4. The container assembly of claim 3 further including spaced protrusions on the legs for gripping the interior surfaces of the sidewalls.

5. The container assembly of claim 2 wherein the prize holding means has a first longitudinal dimension in a first state such that an upper end thereof engages said closure means and holds the closure means open before said skirt is expanded, and assumes a second longitudinal dimension in a second state in response to said compression which is generated by pressing said closure means against said upper end permitting said skirt to expand and said closure means to close.

6. The container assembly of claim 2 wherein said compression is generated by pressure applied to coupling means disposed between the closure means and an upper end of the prize holding means.

7. The container assembly of claim 6 wherein said coupling means comprises an annular recess in one of said closure means or an upper end of the prize holding means and a cooperating rim in the other, one of said recess or rim having spaced protrusions for firmly gripping the other.

8. The container assembly of claim 1 wherein said closure means comprises:

a disc for engaging and sealing the open end of the can about the periphery thereof;

a discharge-opening in the disc; and a tab for opening or closing the discharge opening.

9. The container assembly of claim 8 wherein said prize presentation means comprises:

a guide tube aligned with said discharge opening, said guide tube having at least one opening in fluid communication with said liquid to permit the tube to be at least partially filled with liquid; and said prize is disposed within said guide tube so that buoyant force from said liquid moves the prize from said first position within the prize holding means to the second position in juxtaposed, exposed relationship with the open end of the can at the discharge opening.

10. The container assembly of claim 9 further comprising an air-filled sachet surrounding said prize and a vial for hermetically containing said sachet, said vial being disposed in the liquid in the guide tube.

11. The container assembly of claim 10 further including stop means between said guide tube and said vial precluding the vial from moving completely out of the guide tube as a result of said buoyant force.

12. A method of assembling and using the container assembly of claim 1, the method comprising installing the prize holding means and prize in the interior chamber, closing the container assembly with the closure means and randomly distributing the container assembly amongst non-prize bearing containers.

13. A method of assembling and using the container assembly of claim 2, the method comprising installing the prize holding means and prize in the interior chamber, closing the container assembly with the closure means and randomly distributing the container assembly amongst non-prize bearing containers.

14. A method of assembling and using the container assembly of claim 9, the method comprising installing the prize holding means and prize in the interior chamber, closing the container assembly with the closure means and randomly distributing the container assembly amongst non-prize bearing containers.

15. A package for housing and dispensing consumable liquid products and an associated prize, comprising:

a can for containing the consumable liquid product, said can having an open end and closed end and sidewalls connecting the open and closed ends, said sidewalls having interior surfaces defining an interior chamber;

a consumable liquid product disposed within said interior chamber;

prize holding means positioned within said interior chamber for retaining the prize therein, said prize holding means having at least a portion thereof which is expandable outwardly against the interior surfaces of the sidewalls for firmly gripping the sidewalls and securing the prize holding means in a fixed position relative thereto;

closure means cooperatively associated with the open end of the can for opening and closing the same; and prize presentation means for moving the prize between a first storage position within the prize holding means and a second position in juxtaposed, exposed relationship with the open end of the can in response to opening of the closure means.

16. The package of claim 15 wherein the expandable portion of the prize holding means includes a skirt at a base end thereof for engaging the closed end of the can, and expanding against the interior surfaces of the sidewalls in response to compression of the skirt against the can end.

17. The package of claim 15 wherein said skirt comprises a plurality of spaced legs which bow outwardly against the interior surfaces of the sidewalls in response to said compression.

18. The package of claim 15 further including spaced protrusions on the legs for gripping the interior surfaces of the sidewalls.

19. The package of claim 15 wherein the prize holding means has a first longitudinal dimension in a first state such that an upper end thereof engages said closure means and holds the closure means open before said skirt is expanded, and assumes a second longitudinal dimension in a second state in response to said compression which is generated by pressing said closure means against said upper end permitting said skirt to expand and said closure means to close.

20. The package of claim 15 wherein said compression is generated by pressure applied to coupling means disposed between the closure means and an upper end of the prize holding means.

21. The package of claim 15 wherein said coupling means comprises an annular recess in one of said closure means or an upper end of the prize holding means and a cooperating rim in the other, one of said recess or rim having spaced protrusions for firmly gripping the other.

22. The package of claim 15 wherein said closure means comprises:

a disc for engaging and sealing the open end of the can about the periphery thereof;

a discharge opening in the disc; and a tab for opening or closing the discharge opening.

23. The package of claim 15 wherein said prize presentation means comprises:

a guide tube aligned with said discharge opening, said guide tube having at least one opening in fluid communication with said liquid to permit the tube to be at least partially filled with liquid; and said prize is disposed within said guide tube so that buoyant force from said liquid moves the prize from said first position within the prize holding means to the second position juxtaposed, exposed relationship with the open end of the can at the discharge opening.

24. The package of claim 15 further comprising an air-filled sachet surrounding said prize and a vial for hermetically containing said sachet, said vial being disposed in the liquid in the guide tube.

25. The package of claim 15 further including stop means between said guide tube and said vial precluding the vial from moving completely out of the guide tube as a result of said buoyant force.

26. A method of assembling and using the package of claim 15, the method comprising installing the prize holding means and prize in the interior chamber, closing the can with the closure means and randomly distributing the can amongst non-prize bearing cans.

27. A method of assembling and using the package assembly of claim 16, the method comprising installing the prize holding means and prize in the interior chamber, closing the can with the closure means and randomly distributing the can amongst non-prize bearing cans.

28. A method of assembling and using the package of claim 19, the method comprising installing the prize holding means and prize in the interior chamber, closing the can with the closure means and randomly distributing the can amongst non-prize bearing cans.

* * * * *